US006509518B2

(12) United States Patent
Shigenaga

(10) Patent No.: US 6,509,518 B2
(45) Date of Patent: Jan. 21, 2003

(54) CONNECTING DEVICE FOR A DRUM SET

(75) Inventor: Fumihiro Shigenaga, Hamamatsu (JP)

(73) Assignee: Yamaha Corporation, Shizuoka (JP)

( * ) Notice: Subject to any disclaimer, the term of this patent is extended or adjusted under 35 U.S.C. 154(b) by 0 days.

(21) Appl. No.: 09/915,684

(22) Filed: Jul. 26, 2001

(65) Prior Publication Data

US 2002/0017186 A1 Feb. 14, 2002

(30) Foreign Application Priority Data

Jul. 26, 2000 (JP) ..... 2000-225450

(51) Int. Cl.[7] ..... G10D 13/02

(52) U.S. Cl. ..... 84/421; 84/453; 84/422.1; 84/422.2; 84/422.3; 84/329

(58) Field of Search ..... 84/421, 453, 422.1, 84/422.2, 422.3, 329

(56) References Cited

U.S. PATENT DOCUMENTS 1,607,769 A * 11/1926 Meyer ..... 248/298.1
3,710,670 A * 1/1973 Winkler ..... 84/421
6,107,555 A * 8/2000 Hoshino ..... 84/327

FOREIGN PATENT DOCUMENTS

JP S58-43035 9/1983
JP H5-297863 11/1993

OTHER PUBLICATIONS

TAMA 2000–vol. 20 Catalogue (p. 29, Twin Pedal Attachment TPA90) published by Hoshino Musical nstruments Manufacturing Co., Ltd. in Japan in Apr., 2000.

* cited by examiner

*Primary Examiner*—Shih-Yung Hsieh
(74) *Attorney, Agent, or Firm*—Koda & Androlia

(57) ABSTRACT

A connecting device for a drum set that connects a high-hat stand to a drum foot pedal comprising a first connecting element and a second connecting element. The first connecting element is fastened to the frame of the high-hat stand so that a supporting column of the frame is held between the first fastening portion of the first connecting element, and a plate and the first fastening portion and a plate are connected by two bolts. The second connecting element is fastened to the frame of the drum foot pedal so as to be held by a clamp. The second fastening portion of the first connecting element is placed on the second connecting element so that the slots overlap each other. A bolt is passed through these slots and a nut is attached to the bolt, thus connecting the first and second connecting elements.

1 Claim, 3 Drawing Sheets

CONNECTING DEVICE FOR A DRUM SET

BACKGROUND OF THE INVENTION

1. Field of the Invention

The present invention relates to a connecting device for a drum set, and more specifically relates to a connecting device that connects a high-hat stand and a foot pedal.

2. Prior Art

In most cases, a drummer employs a plurality of different percussion instruments such as cymbals, a bass drum and a snare drum, etc. Cymbals may be played with either hands or feet; in cases where cymbals are played by means of the feet, the cymbals are attached to a high-hat stand, and the instrument is arranged so that the cymbals can be played by depressing (with the foot) a foot board installed on the lower part of the stand as disclosed in, for instance, Japanese Patent Application Laid-Open (Kokai) No. H5-297863.

In the case of a bass drum, the drum is played by means of a drum foot pedal. In the case of such a foot pedal, a beater is caused to pivot by depressing a foot board with the foot; as a result, the beater strikes the drum head of the bass drum as shown in, for instance, Japanese Utility Model Application Publication (Kokoku) No. 58-43035. Accordingly, high-hat stands and foot pedals are commonly set in close proximity to each other. In such cases, playing becomes difficult if there is a relative positional shift between the high-hat stand and the foot pedal so that the setting angle of the bass drum and high-hat stand varies during playing. Accordingly, the two parts are connected by a connecting device so that the setting angle does not vary.

Conventionally, a connecting device which is equipped with first and second connecting elements, and which is arranged so that one end of the first connecting element is fastened to the frame of the high-hat stand by means of bolts and the other end of the first connecting element is similarly fastened to the second connecting element by means of bolts, has been known as a connecting devices of this type that connects a drum foot pedal and a high-hat stand.

However, in the case of the above conventional connecting device, the structure is designed so that the setting angle of the high-hat stand and drum foot pedal cannot be altered unless a plurality of bolts (in concrete terms, three bolts) are loosened; as a result, the setting operation is bothersome and requires considerable time.

SUMMARY OF THE INVENTION

The present invention solves the above-described conventional problems.

The object of the present invention is to provide a connecting device for a drum set that allows changes of the relative positions and orientations of a high-hat stand and a drum foot pedal in the horizontal plane by way of loosening a single tightening tool, so that the time required for setting can be shortened.

The above object is accomplished by a unique structure of the present invention for a connecting device for a drum set that connects a high-hat stand to a drum foot pedal; and the connecting device comprises:

a first connecting element that is fastened to the high-hat stand, the first connecting element comprising a first fastening portion and a second fastening portion, and the first fastening portion being fastened to a frame of the high-hat stand by a first tightening tool; and a second connecting element that is fastened to the drum foot pedal; wherein slots are formed respectively in the second connecting element and in the second fastening portion of the first connecting element so that the slots cross and overlap each other; and a second tightening tool is passed through these slots so as to connect the second connecting element and the second fastening portion of the first connecting element.

In the present invention, slots that overlap each other are formed in the second fastening portion of the first connecting element, and in the second connecting element, and the second fastening portion and second connecting element are connected by passing a second tightening tool through these slots. Accordingly, by way of loosening the second tightening tool and changing the crossing angle and crossing position of the two slots, the relative positions and orientations of the high-hat stand and drum foot pedal can be changed as desired in the horizontal plane. Bolts are used as the tightening tool.

DETAILED DESCRIPTION OF THE INVENTION

Below, the present invention will be described in detail with reference to one embodiment illustrated in the accompanying drawings.

Figure 2:
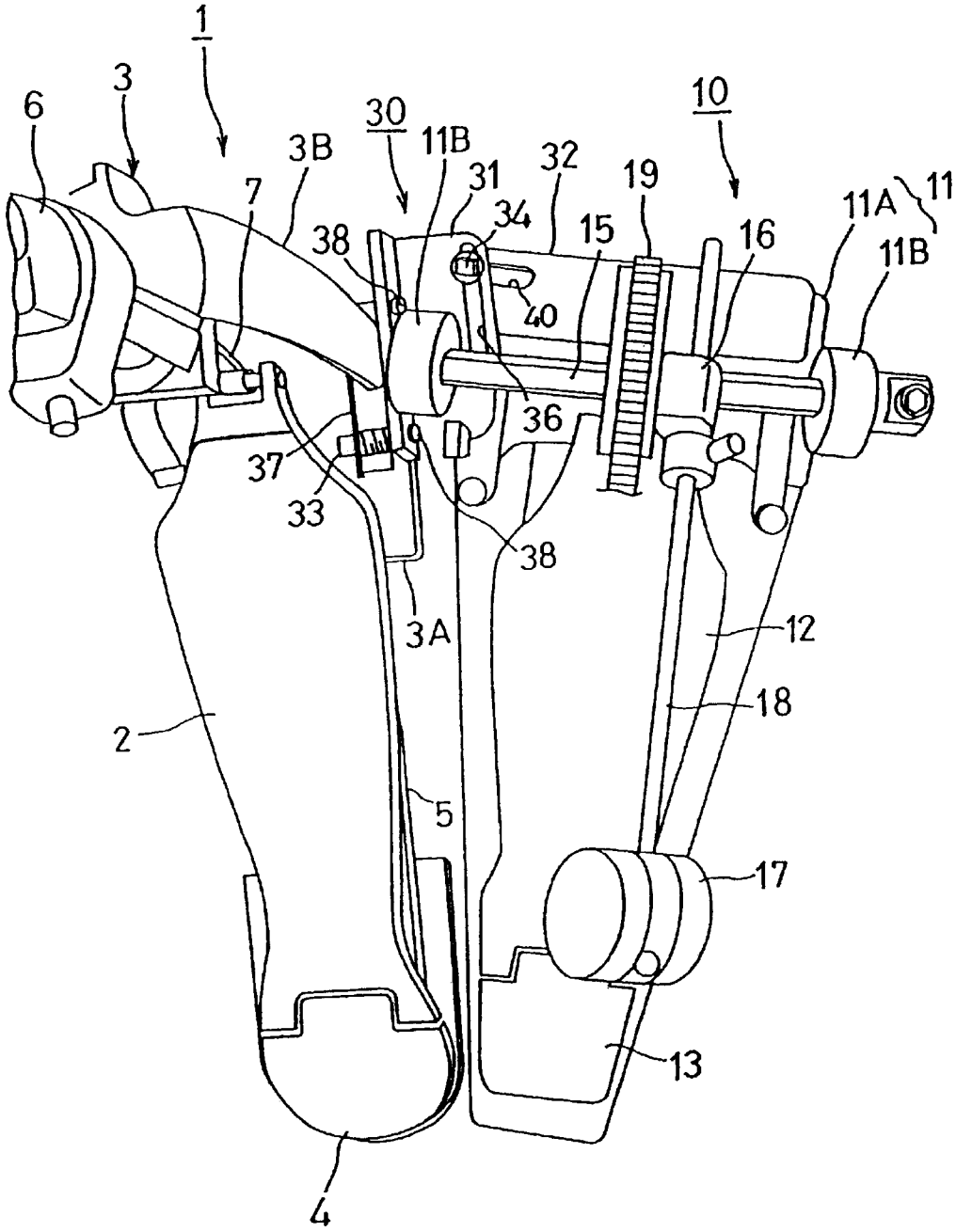
FIG. 2 is a top view of the essential portion of a high-hat stand and a drum foot pedal that are connected by the connecting device of the present invention.
Figure 3:
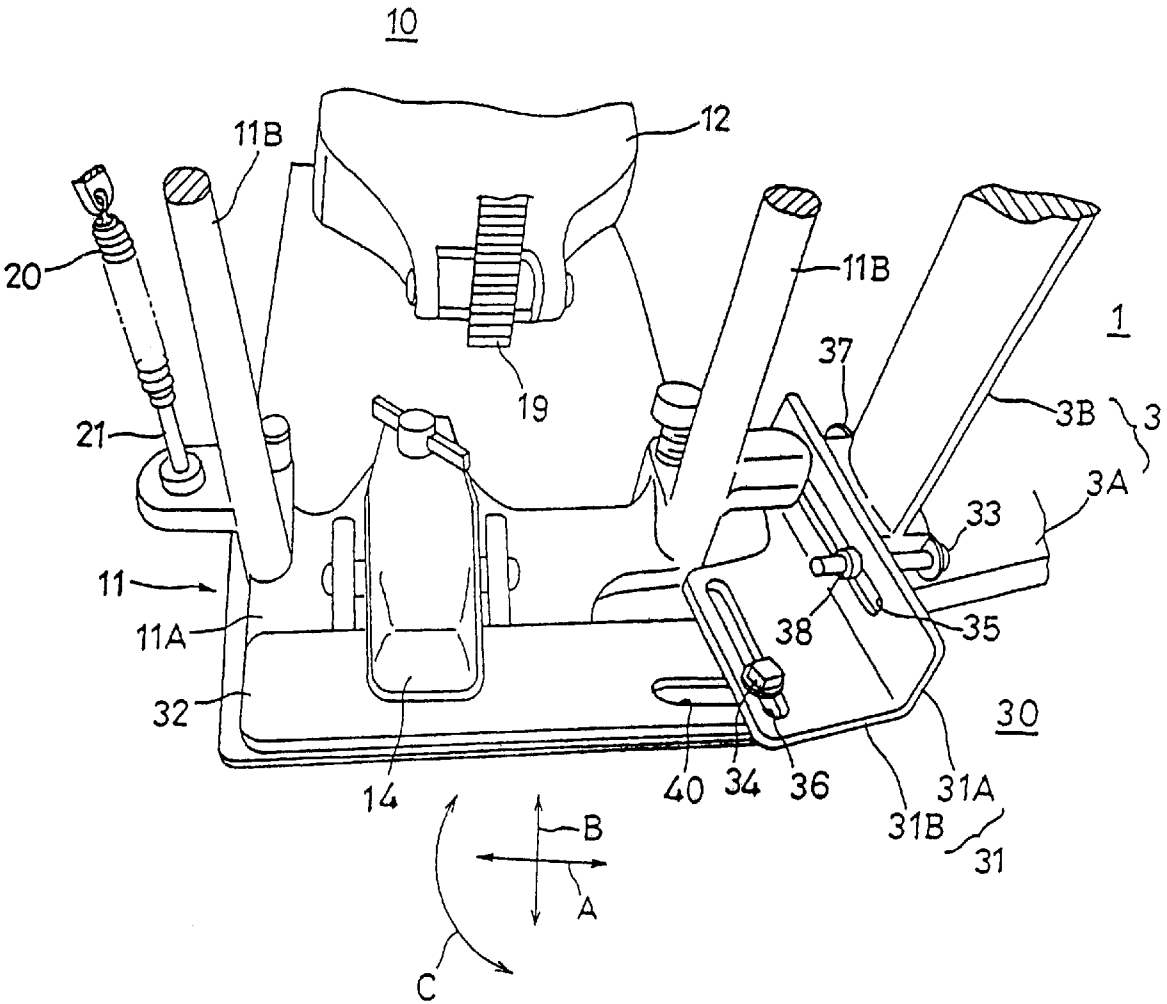
FIG. 3 is a perspective view of the essential portion of the foot pedal seen from the front.

In FIGS. 2 and 3, the reference numeral 1 is a high-hat stand in which cymbals (not shown) are played by depressing a foot board with a foot. The high-hat stand 1 is comprised substantially of a foot board 2, a frame 3 made of metal (an aluminum alloy, etc.), a heel 4, and a connecting rod 5 which connects the frame 3 and heel 4.

The frame 3 is integrally equipped with a frame main body 3A that is installed on the floor surface, and a gate-form supporting leg 3B which is disposed in an upright position on this frame main body 3A. A pipe 6 through which an extension rod (not shown) is passed so that this extension rod is free to move upward and downward is installed in the center of the upper surface of the supporting leg 3B. Furthermore, a lower cymbal is attached to the upper end of this pipe 6, and a spring that drives the extension rod upward is installed inside the pipe 6. An upper cymbal is attached to the upper end of the extension rod so that this upper cymbal faces the lower cymbal, and the lower end of the extension rod is connected to the front end of the foot board 2 by a transmission means 7 such as a belt, etc. Accordingly, when the extension rod is pulled downward as a result of the foot board 2 being depressed with the foot, the lower cymbal can be struck by the upper cymbal. Furthermore, such a high-hat stand 1 is universally known.

The reference numeral 10 is a drum foot pedal. A bass drum (not shown) is played by depressing a foot board with foot. The drum foot pedal 10 is equipped with a frame 11 and a foot board 12. The frame 11 is comprised of a frame main body 11A and two supporting columns 11B. The frame main body 11A is installed on a floor surface, and the supporting columns 11B are respectively installed in upright positions as integral parts of the frame main body 11A on both ends of the upper surface of the frame main body 11A. A heel 13 is connected to the frame main body 11A by a connecting member (not shown).

A clamp 14 which clamps the tightening frame (hoop) of a bass drum (not shown) is attached to the upper surface of the frame main body 11A. The upper end portions of the two supporting columns 11B form bearings, and shaft-support the end portions of a pivoting shaft 15 so that this pivoting shaft 15 is pivoted.

A rocker 16 is attached to the center of the pivoting shaft 15, and a beater 17 that strikes the drum head of the bass drum is attached to this rocker 16 via a beater rod 18. Furthermore, the upper end of a transmission member 19 such as a chain, etc., which transmits the depressing force applied to the foot board 12 to the pivoting shaft 15 is fastened to the rocker 16. The lower end of this transmission member 19 is connected to the front end of the foot board 12.

A pivoting inertia in the return direction is applied to the pivoting shaft 15 by a return spring 20. As a result, the front end of the foot board 12 is ordinarily lifted upward. The upper end of the return spring 20 is connected to the pivoting shaft 15 via a cam plate, and the lower end of the return spring 20 is connected to a spring receiving member 21 that is installed on the lower end portion of one of the supporting columns 11B.

Accordingly, when the transmission member 19 is pulled downward by depressing the foot board 12 with the foot, the beater rod 18 pivots along with the pivoting shaft 15 so that the beater 17 strikes the drum head of the bass drum. Such a drum foot pedal 10 is universally known.

Figure 1A:
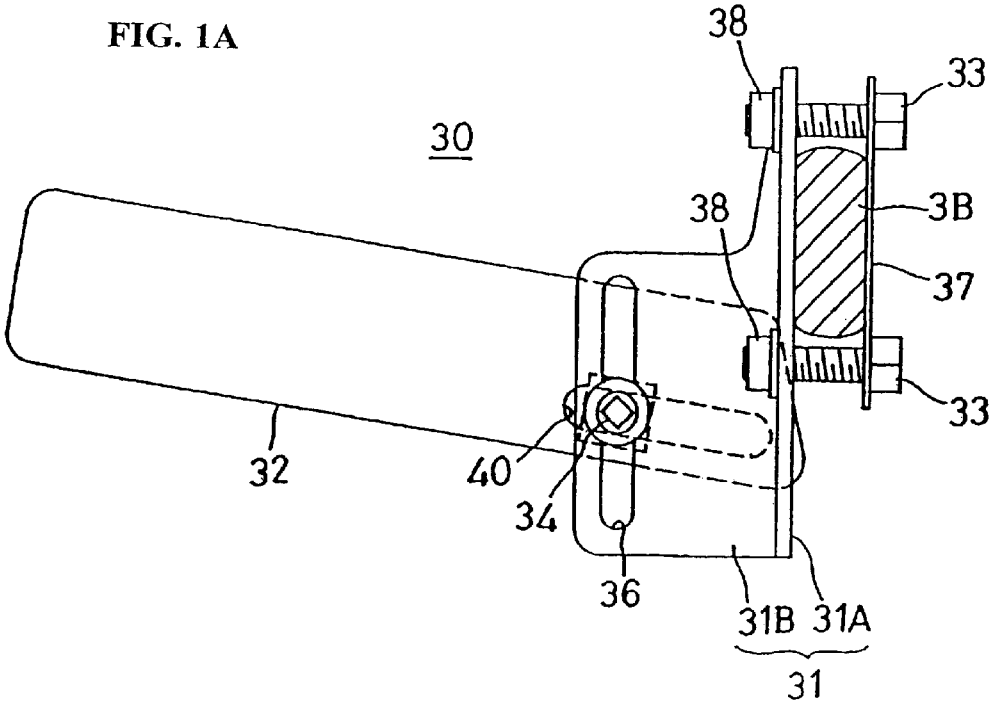
FIG. 1A is a top view of one embodiment of the connecting device according to the present invention.
Figure 1B:
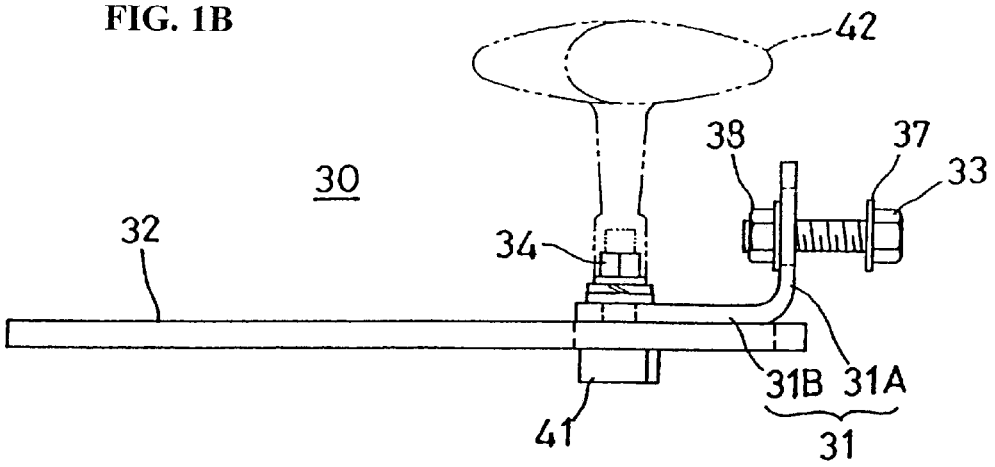
FIG. 1B is a front view thereof.
Figure 1C:
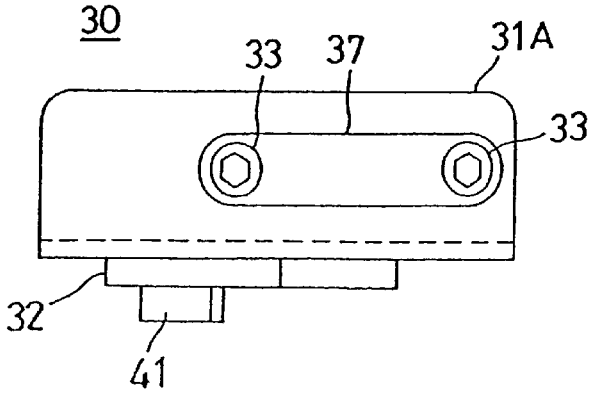
FIG. 1C is a top view thereof.

In FIGS. 1 through 3, the reference numeral 30 is a connecting device that connects the high-hat stand 1 and the drum foot pedal 10. The connecting device 30 is equipped with first and second connecting elements 31 and 32, two bolts (first tightening tools) 33 which fasten the first connecting element 31 to the frame 3 of the high-hat stand 1, and one bolt (second tightening tool) 34 which connects the first connecting element 31 and second connecting element 32, etc.

The first connecting element 31 is comprised of a substantially vertical first fastening portion 31A and a horizontal second fastening portion 31B that are formed by forming a metal plate into an L shape. Long horizontal slots 35 and 36 are respectively formed in the front-back direction in the first and second fastening portions 31A and 31B. The first fastening portion 31A clamps the supporting column 3B positioned on the drum foot pedal 10 side of the frame 3 of the high-hat stand 1 together with a plate 37. When two bolts 33 are passed through the slot 35 and bolt through-holes formed in both end portions of the plate 37, and nuts 38 are tightened on these bolts 33, then the first fastening portion 31A is fastened to the outside surface of the supporting column 3B. In this case, the slot 35 is arranged so that the position of the first connecting element 31 in the front-back direction relative to the frame 3 can be adjusted.

The second connecting element 32 consists of a rectangular metal plate which is long in the left-right direction; a long slot 40 which extends in the left-right direction is formed in one end portion of this second connecting element 32 with respect to the direction of length. Furthermore, this second connecting element 32 is placed on the surface of the frame main body 11A of the drum foot pedal 10, and is clamped by the clamp 14. Furthermore, the clamp 14 also clamps the tightening frame of the bass drum carried on the second connecting element 32, and fastens both of these members to the frame main body 11A.

When the first connecting element 31 and second connecting element 32 are connected, the second connecting element 32 is first placed on the surface of the frame main body 11A and clamped by the clamp 14, so that the first connecting element 31 is fastened in the desired position.

Next, the position and orientation of the high-hat stand 1 with respect to the drum foot pedal 10 are determined, and the second fastening portion 31B is placed on the surface of the second connecting element 32 so that the slot 36 overlaps with the slot 40.

Then, one supporting column 3B of the frame 3 is clamped by the first fastening portion 31A of the first connecting element 31 and the plate 37; and the bolts 33 are passed through the bolt through-holes formed in the plate 37 and the slot 35 in the first fastening portion 31A, and the nuts 38 are screwed onto the bolts 33. The first fastening portion 31A is thus fastened to the supporting column 3B.

Furthermore, the bolt 34 is passed through the slot 36 in the second fastening portion 31B and the slot 40 in the second connecting element 32 from above, and a nut 41 is screwed onto the bolt 34. The second fastening portion 31B and second connecting element 32 are thus connected. A bass drum tuning key 42 is used to tighten the bolts 33 and 34.

There is a case in which the setting angle of the high-hat stand 1 with respect to the drum foot pedal 10, or the setting angle of the drum foot pedal 10 with respect to the bass drum, etc., is adjusted according to the preference of the user after the first and second connecting elements 31 and 32 have been connected. In such a case, the relative positions and orientations of the high-hat stand 1 and foot pedal 10 in the horizontal plane can be changed by loosening the bolt 34 by means of a tuning key 42 and moving the frames 3 and 11 in the directions indicated by the arrows A and B, or by pivoting these components in the direction indicated by the arrow C as shown in FIG. 3. Since only a single bolt 34 needs be loosened, the setting work is easy, and can be accomplished in a short time.

The first connecting element 31 is attached to the frame 3 so that the supporting column 3B is first clamped between the first fastening portion 31A and the plate 37, and then the first fastening portion 31A and plate 37 are connected by the bolts 33. Thus, there is no need for special working on the components in order to fasten the first connecting element 31 to the frame 3, and an existing high-hat stand 1 can be used "as is". Likewise, the second connecting element 32 is attached to the frame 11 by way of clamping the second connecting element 32 by the clamp 14. Thus, there is no need for special working on the components in order to fasten the second connecting element 32 to the frame 11. Thus, an existing drum foot pedal 10 can be used "as is".

As seen from the above, the connecting device for a drum set of the present invention is comprised of first and second connecting elements; and a slot formed in the first connecting element and a slot formed in the second connecting element are caused to overlap each other, and then a single tightening tool is passed through the slots, thus connecting the first and second connecting elements. Accordingly, the relative positions and orientations of the high-hat stand and drum foot pedal in the horizontal plane can be changed as desired merely by loosening the tightening tools, so that setting work is easy and can be accomplished in a short time. Furthermore, there is no need for special working or the addition of special parts to the high-hat stand or drum foot pedal; and existing components can be used "as is".

I claim:

1. A connecting device for a drum set that connects a high-hat stand to a drum foot pedal, comprising:

a first connecting element that is fastened to said high-hat stand, said first connecting element comprising a first fastening portion and a second fastening portion and said first fastening portion being fastened to a frame of said high-hat stand by a first tightening tool; and a second connecting element that is fastened to said drum foot pedal; wherein slots are formed respectively in said second connecting element and in said second fastening portion of said first connecting element, said slots crossing and overlapping each other; and a second tightening tool is passed through said slots so as to connect said second connecting element and said second fastening portion of said first connecting element.

* * * * *